US007776800B2

(12) United States Patent
Lam et al.

(10) Patent No.: US 7,776,800 B2
(45) Date of Patent: Aug. 17, 2010

(54) TITANIUM-CONTAINING LUBRICATING OIL COMPOSITION

(75) Inventors: William Y. Lam, Glen Allen, VA (US); Gregory H. Guinther, Richmond, VA (US); Carl K. Esche, Jr., Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 836 days.

(21) Appl. No.: 11/298,006

(22) Filed: Dec. 9, 2005

(65) Prior Publication Data

US 2007/0132274 A1 Jun. 14, 2007

(51) Int. Cl.
*C10M 125/26* (2006.01)
*C10M 125/00* (2006.01)

(52) U.S. Cl. ..... 508/165; 508/179; 508/371; 123/1 A

(58) Field of Classification Search ..... 508/459, 508/165, 179, 371; 123/1 A
See application file for complete search history.

(56) References Cited

U.S. PATENT DOCUMENTS

| | | | |
|---|---|---|---|
| 2,160,273 | A | 5/1939 | Loane et al. |
| 2,384,577 | A | 9/1945 | Thomas |
| 2,621,195 | A | 12/1952 | Haslam |
| 2,710,872 | A | 6/1955 | Thompson |
| 2,719,125 | A | 9/1955 | Roberts |
| 2,719,126 | A | 9/1955 | Fields, et al. |
| 2,786,866 | A | 3/1957 | Hook et al. |
| 2,897,152 | A | 7/1959 | Elliott et al. |
| 2,960,469 | A | 11/1960 | Young |
| 2,995,569 | A | 8/1961 | Hamilton et al. |
| 3,087,932 | A | 4/1963 | Lille, Jr. |
| 3,219,666 | A | 11/1965 | Norman et al. |
| 3,277,002 | A | 10/1966 | Hunt et al. |
| 3,356,702 | A | 12/1967 | Farmer et al. |
| 3,399,139 | A | 8/1968 | Forbes et al. |
| 3,407,222 | A | 10/1968 | Lies |
| 3,445,386 | A | 5/1969 | Otto et al. |
| 3,458,548 | A | 7/1969 | Carlson |
| 3,509,051 | A | 4/1970 | Farmer et al. |
| 3,565,804 | A | 2/1971 | Honnen et al. |
| 3,673,090 | A | 6/1972 | Walbillig et al. |
| 3,697,574 | A | 10/1972 | Piasek et al. |
| 3,699,118 | A | 10/1972 | Donham |
| 3,703,504 | A | 11/1972 | Horodysky |
| 3,703,505 | A | 11/1972 | Horodysky et al. |
| 3,736,357 | A | 5/1973 | Piasek et al. |
| 3,758,493 | A | 9/1973 | Maddox, Jr. |
| 3,794,081 | A | 2/1974 | Fiser et al. |
| 3,796,661 | A | 3/1974 | Suratwala et al. |
| 3,821,236 | A | 6/1974 | Ripple |
| 3,867,359 | A | 2/1975 | Beadle |
| 3,873,454 | A | 3/1975 | Horodysky et al. |
| 3,904,537 | A | 9/1975 | Ripple |
| 3,969,281 | A | 7/1976 | Sharp |
| 4,029,587 | A | 6/1977 | Koch |
| 4,097,387 | A | 6/1978 | Caspari |
| 4,098,705 | A | 7/1978 | Sakurai et al. |
| 4,107,059 | A | 8/1978 | King et al. |
| 4,122,033 | A | 10/1978 | Black |
| 4,136,043 | A | 1/1979 | Davis |
| 4,164,473 | A | 8/1979 | Coupland et al. |
| 4,171,268 | A | 10/1979 | Collins |
| 4,176,073 | A | 11/1979 | Ryer et al. |
| 4,176,074 | A | 11/1979 | Coupland et al. |
| 4,178,258 | A | 12/1979 | Papay et al. |
| 4,188,299 | A | 2/1980 | Caspari |
| 4,192,757 | A | 3/1980 | Brewster |
| 4,193,882 | A | 3/1980 | Gemmill, Jr. |
| 4,210,683 | A | 7/1980 | Praxl et al. |
| 4,248,720 | A | 2/1981 | Coupland et al. |
| 4,259,195 | A | 3/1981 | King et al. |
| 4,261,843 | A | 4/1981 | King et al. |
| 4,263,152 | A | 4/1981 | King et al. |
| 4,265,773 | A | 5/1981 | deVries et al. |
| 4,266,945 | A | 5/1981 | Karn |
| 4,272,387 | A | 6/1981 | King et al. |
| 4,283,295 | A | 8/1981 | DeVries et al. |
| 4,285,822 | A | 8/1981 | DeVries et al. |
| 4,289,635 | A | 9/1981 | Schroeck |
| 4,362,633 | A | 12/1982 | Spence et al. |

(Continued)

FOREIGN PATENT DOCUMENTS

| | | |
|---|---|---|
| EP | 330522 | 12/1994 |

(Continued)

*Primary Examiner*—Glenn Caldarola
*Assistant Examiner*—Jim Goloboy
(74) *Attorney, Agent, or Firm*—Luedeka, Neely & Graham, PC

(57) ABSTRACT

A lubricating oil composition comprising a) an oil of lubricating viscosity having a viscosity index of at least about 95; b) at least one calcium detergent; c) at least one oil soluble titanium compound; d) at least one friction modifier; and e) at least one metal dihydrocarbyldithiophosphate compound. The composition has a Noack volatility of about 15 wt. % or less, and contains from about 0.05 to about 0.6 wt. % calcium from the calcium detergent, titanium metal in an amount of at least about 10 ppm up to about 1500 ppm titanium from the titanium compound, and phosphorus from the metal dihydrocarbyldithiophosphate compound in an amount up to about 0.1 wt. %.

19 Claims, No Drawings

U.S. PATENT DOCUMENTS 4,363,322 A 12/1982 Andersson
4,369,119 A 1/1983 De Vries et al.
4,395,343 A 7/1983 De Vries et al.
4,402,840 A 9/1983 De Vries et al.
4,466,901 A 8/1984 Hunt et al.
4,479,883 A 10/1984 Shaub et al.
4,517,114 A 5/1985 Oppenlaender et al.
4,636,322 A 1/1987 Nalesnik
4,654,156 A 3/1987 Horodysky et al.
4,692,256 A 9/1987 Umemura et al.
4,702,850 A 10/1987 Gutierrez et al.
4,713,184 A 12/1987 Zaid
4,758,362 A 7/1988 Butke
4,765,918 A 8/1988 Love et al.
4,824,611 A 4/1989 Cells
4,838,931 A 6/1989 Liebl et al.
4,849,123 A 7/1989 Tipton et al.
4,857,214 A 8/1989 Papay et al.
4,867,890 A 9/1989 Colclough et al.
4,876,375 A 10/1989 Lam
4,885,365 A 12/1989 Lam
4,889,647 A 12/1989 Rowan et al.
4,904,401 A 2/1990 Ripple et al.
4,927,552 A 5/1990 Lam
4,938,880 A 7/1990 Waddoups et al.
4,957,643 A 9/1990 Lam
4,957,649 A 9/1990 Ripple et al.
4,962,256 A 10/1990 Le et al.
4,966,719 A 10/1990 Coyle et al.
4,978,464 A 12/1990 Coyle et al.
4,990,271 A 2/1991 Francis
4,995,996 A 2/1991 Coyle et al.
5,000,863 A 3/1991 Watanabe
5,027,901 A 7/1991 French et al.
5,055,211 A 10/1991 Habeeb et al.
5,055,521 A 10/1991 Habeeb et al.
5,110,488 A * 5/1992 Tipton et al. ..... 508/192
5,204,012 A 4/1993 Schaffhausen
5,242,613 A 9/1993 Ozbalik et al.
5,260,466 A 11/1993 McGibbon
5,286,394 A 2/1994 Moore
5,287,731 A 2/1994 Florkowski et al.
5,292,480 A 3/1994 Fischer et al.
5,322,640 A 6/1994 Byrne et al.
5,328,620 A 7/1994 Ripple
5,401,661 A 3/1995 Florkowski et al.
5,412,130 A 5/1995 Karol
5,484,542 A 1/1996 Cahoon et al.
5,486,300 A 1/1996 Salomon et al.
5,490,945 A 2/1996 Smith et al.
5,498,809 A * 3/1996 Emert et al. ..... 585/13
5,562,864 A 10/1996 Salomon et al.
5,627,259 A 5/1997 Thaler et al.
5,633,326 A 5/1997 Patil et al.
5,643,859 A 7/1997 Gutierrez et al.
5,686,397 A 11/1997 Baranski et al.
5,693,598 A 12/1997 Abraham et al.
5,747,430 A 5/1998 Matsushita et al.
5,753,596 A 5/1998 Martin et al.
5,759,485 A 6/1998 Fischer et al.
5,773,391 A 6/1998 Lawate et al.
5,789,357 A 8/1998 Baranski et al.
5,792,729 A 8/1998 Harrison et al.
5,851,965 A 12/1998 Harrison et al.
5,853,434 A 12/1998 Harrison et al.
5,902,776 A 5/1999 Dohner et al.
5,936,041 A 8/1999 Diana et al.
5,939,362 A 8/1999 Johnson et al.
6,034,040 A 3/2000 Ozbalik et al.
6,074,444 A 6/2000 Bingley
6,096,691 A 8/2000 Conary et al.
6,103,674 A 8/2000 Nalesnik et al.
6,114,288 A 9/2000 Fujitsu et al.
6,117,826 A 9/2000 Baranski et al.
6,172,012 B1 1/2001 Kumar et al.
6,232,276 B1 5/2001 Stiefel et al.
6,268,316 B1 * 7/2001 Tanaka et al. ..... 508/291
6,300,291 B1 10/2001 Hartley et al.
6,333,298 B1 12/2001 Waddoups et al.
6,338,819 B1 1/2002 Braga et al.
6,509,303 B1 1/2003 Gatto
6,528,463 B1 3/2003 Gatto et al.
6,723,685 B2 4/2004 Hartley et al.
6,800,594 B2 10/2004 Miksic et al.
2004/0033908 A1 * 2/2004 Deckman et al. ..... 508/110
2004/0102336 A1 * 5/2004 Boffa ..... 508/199
2004/0200996 A1 10/2004 Meyer
2004/0204325 A1 10/2004 Takahashi
2005/0065045 A1 * 3/2005 Wilk et al. ..... 508/399
2005/0107269 A1 5/2005 Yagishita et al.
2006/0217271 A1 * 9/2006 Brown et al. ..... 508/165

FOREIGN PATENT DOCUMENTS

EP 874040 10/1998
EP 0995790 4/2000
GB 866054 4/1961
GB 1560830 2/1980
JP 61-111397 5/1986
JP 62236894 10/1987
JP 03-190997 A 8/1991
JP 10-259392 A 9/1998
JP 11-131084 A 5/1999
JP 2002-302691 10/2002
JP 2004149762 5/2004
JP 2004155881 A1 6/2004
JP 2004-182829 A 7/2004
SU 1669975 A 8/1991
SU 1669976 A 8/1991
WO 8704454 7/1987
WO WO 8704454 A * 7/1987
WO WO 9811181 3/1998
WO WO 02092734 11/2002

* cited by examiner

TITANIUM-CONTAINING LUBRICATING OIL COMPOSITION

TECHNICAL FIELD

The disclosure relates to lubricating oil compositions. More particularly, the disclosure relates to lubricating oil compositions including titanium-containing compounds for improved lubricating performance properties.

BACKGROUND AND SUMMARY

Lubricating oil compositions used to lubricate internal combustion engines contain a base oil of lubricating viscosity, or a mixture of such oils, and additives used to improve the performance characteristics of the oil. For example, additives are used to improve detergency, to reduce engine wear, to provide stability against heat and oxidation, to reduce oil consumption, to inhibit corrosion, to act as a dispersant, and to reduce friction loss. Some additives provide multiple benefits, such as dispersant-viscosity modifiers. Other additives, while improving one characteristic of the lubricating oil, have an adverse effect on other characteristics. Thus, to provide lubricating oil having optimal overall performance, it is necessary to characterize and understand all the effects of the various additives available, and carefully balance the additive content of the lubricant.

It has been proposed in many patents and articles (for example, U.S. Pat. Nos. 4,164,473; 4,176,073; 4,176,074; 4,192,757; 4,248,720; 4,201,683; 4,289,635; and 4,479,883) that oil-soluble molybdenum compounds are useful as lubricant additives. In particular, the addition of molybdenum compounds to oil, particularly molybdenum dithiocarbamate compounds, provide the oil with improved boundary friction characteristics and bench tests demonstrate that the coefficient of friction of oil containing such molybdenum compounds is generally lower than that of oil containing organic friction modifiers. This reduction in coefficient of friction results in improved antiwear properties and may contribute to enhanced fuel economy in gasoline or diesel fired engines, including both short- and long-term fuel economy properties (i.e., fuel economy retention properties). To provide antiwear effects, molybdenum compounds are generally added in amounts introducing from about 350 ppm up to 2,000 ppm of molybdenum into the oil. While molybdenum compounds are effective antiwear agents and may further provide fuel economy benefits, such molybdenum compounds are expensive relative to more conventional, metal-free (ashless) organic friction modifiers U.S. Pat. No. 6,300,291 discloses a lubricating oil composition having a specified Noack volatility containing a base oil of a specified viscosity index, calcium-based detergent, zinc dihydrocarbyldithiophosphate (ZDDP) antiwear agent, a molybdenum compound and a nitrogen-containing friction modifier. The molybdenum compound was used in an amount providing the formulated lubricant with up to 350 ppm of molybdenum. The claimed materials are described as providing fuel economy benefits compared to compositions containing only molybdenum compounds. Despite the foregoing, there continues to be a need for more cost effective lubricant compositions that provide equivalent or superior performance to lubricant compositions without the presence of molybdenum-based friction modifiers.

In accordance with a first aspect, one exemplary embodiment of the disclosure provides an improved lubricating oil composition substantially devoid of molybdenum compounds that may provide equivalent or superior lubricating properties. The lubricating oil composition includes an oil of lubricating viscosity having a viscosity index (VI) of at least about 95; a calcium detergent in an amount introducing from about 0.05 to about 0.6 wt. % calcium into the composition; an amount of a metal dihydrocarbyldithiophosphate compound introducing up to about 0.1 wt. % (1000 ppm) of phosphorus into the composition; at least one titanium compound in an amount sufficient to provide the composition with at least 10 ppm up to about 1500 ppm of titanium. The composition has a Noack volatility of less than about 15% and contains an effective amount of at least one friction modifier.

In accordance with a second aspect, the disclosure is directed to a method of improving the fuel economy and/or the wear characteristics of an internal combustion engine, which method comprises the steps of lubricating an internal combustion engine with a lubricating oil composition of the first aspect and operating the engine.

In accordance with a third aspect, the disclosure is directed to the use of a lubricating oil composition of the first aspect to improve the fuel economy, and/or the wear characteristics of an internal combustion engine.

Other and further objects, advantages and features of the disclosed embodiments may be understood by reference to the following.

DESCRIPTION OF THE EXEMPLARY EMBODIMENTS

The oil of lubricating viscosity may be at least one oil selected from the group consisting of Group I, Group II, and/or Group III base stocks or base oil blends of the aforementioned base stocks provided that the viscosity of the base oil or base oil blend is at least 95 and allows for the formulation of a lubricating oil composition having a Noack volatility, measured by determining the evaporative loss in mass percent of an oil after 1 hour at 250° C. according to the procedure of ASTM D5880, of less than 15%. In addition, the oil of lubricating viscosity may be one or more Group IV or Group V base stocks or combinations thereof or base oil mixtures containing one or more Group IV or Group V base stocks in combination with one or more Group I, Group II and/or Group III base stocks. Other base oils may include at least a portion comprising a base oil derived from a gas to liquid process.

The most desirable base oils for fuel economy retention, are:

(a) Base oil blends of Group III base stocks with Group I or Group II base stocks, where the combination has a viscosity index of at least 110; or (b) Group III, IV or V base stocks or base oil blends of more than one Group III, IV or V base stocks, where the viscosity index is between about 120 to about 140.

Definitions for the base stocks and base oils in disclosure are the same as those found in the American Petroleum Institute (API) publication "Engine Oil Licensing and Certification System", Industry Services Department, Fourteenth Edition, December 1996, Addendum 1, December 1998. Said publication categorizes base stocks as follows:

a) Group I base stocks containing less than 90 percent saturates and/or greater than 0.03 percent sulfur and having a viscosity index greater than or equal to 80 and less than 120 using the test methods specified in Table 1.

b) Group II base stocks containing greater than or equal to 90 percent saturates and less than or equal to 0.03 percent sulfur and having a viscosity index greater than or equal to 80 and less than 120 using the test methods specified in Table 1.

c) Group III base stocks containing greater than or equal to 90 percent saturates and less than or equal to 0.03 percent sulfur and having a viscosity index greater than or equal to 120 using the test methods specified in Table 1.

d) Group IV base stocks that are polyalphaolefins (PAO).

e) Group V base stocks that include all other base stocks not included in Group I, II, III, or IV.

TABLE 1

Analytical Methods for Base Stock

| Property | Test Method |
|---|---|
| Saturates | ASTM D 2007 |
| Viscosity Index | ASTM D 2270 |
| Sulfur | ASTM D 2662, ASTM D 4294<br>ASTM D 4927, ASTM D 3120 |

For the lubricating oil compositions disclosed herein, any suitable hydrocarbon-soluble titanium compound having friction modifying and/or extreme pressure, and/or antioxidant, and/or anti-wear properties in lubricating oil compositions may be used. The terms "hydrocarbon soluble," "oil soluble," or "dispersable" are not intended to indicate that the compounds are soluble, dissolvable, miscible, or capable of being suspended in a hydrocarbon compound or oil in all proportions. These do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

The term "hydrocarbyl" refers to a group having a carbon atom attached to the remainder of the molecule and having predominantly hydrocarbon character. Examples of hydrocarbyl groups include:

1. Hydrocarbon substituents, that is, aliphatic (for example alkyl or alkenyl), alicyclic (for example cycloalkyl or cycloalkenyl) substituents, aromatic-, aliphatic- and alicyclic-substituted aromatic nuclei and the like, as well as cyclic substituents wherein the ring is completed through another portion of the ligand (that is, any two indicated substituents may together form an alicyclic group).
2. Substituted hydrocarbon substituents, that is, those containing non-hydrocarbon groups which, in the context of this invention, do not alter the predominantly hydrocarbyl character of the substituent. Those skilled in the art will be aware of suitable groups (e.g., halo, especially chloro and fluoro, amino, alkoxyl, mercapto, alkylmercapto, nitro, nitroso, sulfoxy, etc.).
3. Hetero substituents, that is, substituents which, while predominantly hydrocarbon in character within the context of this invention, contain atoms other than carbon present in a chain or ring otherwise composed of carbon atoms.

Importantly, the organo groups of the ligands have a sufficient number of carbon atoms to render the compound soluble or dispersible in the oil or hydrocarbon fluid. For example, the number of carbon atoms in each group will generally range between about 1 to about 100, preferably from about 1 to about 30, and more preferably between about 4 to about 20.

The hydrocarbon soluble titanium compounds suitable for use as a herein, for example as a friction modifier, extreme pressure agent, or antioxidant are provided by a reaction product of a titanium alkoxide and an about $C_6$ to about $C_{25}$ carboxylic acid. The reaction product may be represented by the following formula:

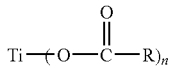

wherein n is an integer selected from 2, 3 and 4, and R is a hydrocarbyl group containing from about 5 to about 24 carbon atoms, or by the formula:

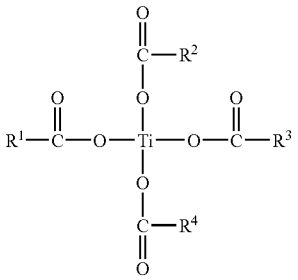

wherein each of $R^1$, $R^2$, $R^3$, and $R^4$ are the same or different and are selected from a hydrocarbyl group containing from about 5 to about 25 carbon atoms. Compounds of the foregoing formulas are essentially devoid of phosphorous and sulfur.

In an embodiment, the hydrocarbon soluble titanium compound may be substantially or essentially devoid or free of sulfur and phosphorus atoms such that a lubricant or formulated lubricant package comprising the hydrocarbon soluble titanium compound contains about 0.7 wt % or less sulfur and about 0.12 wt % or less phosphorus.

In another embodiment, the hydrocarbon soluble titanium compound may be substantially free of active sulfur. "Active" sulfur is sulfur which is not fully oxidized. Active sulfur further oxidizes and becomes more acidic in the oil upon use.

In yet another embodiment, the hydrocarbon soluble titanium compound may be substantially free of all sulfur. In a further embodiment, the hydrocarbon soluble titanium compound may be substantially free of all phosphorus. In a still further embodiment, the hydrocarbon soluble titanium compound may be substantially free of all sulfur and phosphorus. For example, the base oil in which the titanium compound may be dissolved in may contain relatively small amounts of sulfur, such as in one embodiment, less than about 0.5 wt % and in another embodiment, about 0.03 wt % or less sulfur (e.g., for Group II base oils), and in a still further embodiment, the amount of sulfur and/or phosphorus may be limited in the base oil to an amount which permits the finished oil to meet the appropriate motor oil sulfur and/or phosphorus specifications in effect at a given time.

Examples of titanium/carboxylic acid products include, but are not limited to, titanium reaction products with acids selected from the group consisting essentially of caproic acid, caprylic acid, lauric acid, myristic acid, palmitic acid, stearic acid, arachidic acid, oleic acid, erucic acid, linoleic acid, linolenic acid, cyclohexanecarboxylic acid, phenylacetic acid, benzoic acid, neodecanoic acid, and the like. Methods for making such titanium/carboxylic acid products are described, for example, in U.S. Pat. No. 5,260,466, the disclosure of which is incorporated herein by reference.

The following examples are given for the purpose of exemplifying aspects of the embodiments and are not intended to limit the embodiments in any way.

Example 1

Synthesis of Titanium Neodecanoate

Neodecanoic acid (about 600 grams) was placed into a reaction vessel equipped with a condenser, Dean-Stark trap, thermometer, thermocouple, and a gas inlet. Nitrogen gas was bubbled into the acid. Titanium isopropoxide (about 245 grams) was slowly added to the reaction vessel with vigorous stirring. The reactants were heated to about 140° C. and stirred for one hour. Overheads and condensate from the reaction were collected in the trap. A subatmospheric pressure was applied to the reaction vessel and the reactants were stirred for about an additional two hours until the reaction was complete. Analysis of the product indicated that the product had a kinematic viscosity of about 14.3 cSt at about 100° C. and a titanium content of about 6.4 percent by weight.

Example 2

Synthesis of Titanium Oleate

Oleic acid (about 489 grams) was placed into a reaction vessel equipped with a condenser, Dean-Stark trap, thermometer, thermocouple, and a gas inlet. Nitrogen gas was bubbled into the acid. Titanium isopropoxide (about 122.7 grams) was slowly added to the reaction vessel with vigorous stirring. The reactants were heated to about 140° C. and stirred for one hour. Overheads and condensate from the reaction were collected in the trap. A subatmospheric pressure was applied to the reaction vessel and the reactants were stirred for about an additional two hours until the reaction was complete. Analysis of the product indicated that the product had a kinematic viscosity of about 7.0 cSt at about 100° C. and a titanium content of about 3.8 percent by weight.

The hydrocarbon soluble titanium compounds of the embodiments described herein are advantageously incorporated into lubricating compositions. Accordingly, the hydrocarbon soluble titanium compounds may be added directly to the lubricating oil composition. In one embodiment, however, hydrocarbon soluble titanium compounds are diluted with a substantially inert, normally liquid organic diluent such as mineral oil, synthetic oil (e.g., ester of dicarboxylic acid), naptha, alkylated (e.g., $C_{10}$-$C_{13}$ alkyl) benzene, toluene or xylene to form a metal additive concentrate. The titanium additive concentrates usually contain from about 0% to about 99% by weight diluent oil.

The lubricating compositions of the disclosed embodiment contain the titanium compound in an amount providing the compositions with at least 10 ppm of titanium. An amount of at least 10 ppm of titanium from a titanium compound has been found to be effective to provide a fuel economy benefit in combination with a second friction modifier selected from nitrogen containing friction modifiers; organic polysulfide friction modifiers; amine-free friction modifiers, and organic, ashless, nitrogen-free friction modifiers.

Desirably, the titanium from a titanium compound is present in an amount of from about 10 ppm to about 1500 ppm, such as 10 ppm to 1000 ppm, more desirably from about 50 ppm to 500 ppm, and still more desirably in an amount of from about 75 ppm to about 250 ppm, based on the total weight of the lubricating composition. Because such titanium compounds may also provide antiwear credits to lubricating oil compositions, the use thereof allows for a reduction in the amount of metal dihydrocarbyl dithiophosphate antiwear agent (e.g., ZDDP) employed. Industry trends are leading to a reduction in the amount of ZDDP being added to lubricating oils to reduce the phosphorous content of the oil to below 1000 ppm, such as to 250 ppm to 750 ppm, or 250 ppm to 500 ppm. To provide adequate wear protection in such low phosphorous lubricating oil compositions, the titanium compound should be present in an amount providing at least 50 ppm by mass of titanium. The amount of titanium and/or zinc may be determined by Inductively Coupled Plasma (ICP) emission spectroscopy using the method described in ASTM D5185.

In a similar manner, the use of the titanium compounds in lubricating compositions may facilitate the reduction of antioxidant and extreme pressure agents in the lubricating compositions.

Friction Modifiers

At least one oil soluble friction modifier must be incorporated in the lubricating oil compositions described herein as a second friction modifier. The second friction modifier may be selected from nitrogen-containing, nitrogen-free and/or amine free friction modifiers. Typically, the second friction modifier may be used in an amount ranging from about 0.02 to 2.0 wt. % of the lubricating oil composition. Desirably, from 0.05 to 1.0, more desirably from 0.1 to 0.5, wt. % of the second friction modifier is used.

Examples of such nitrogen containing friction modifiers that may be used include, but are not limited to, imidazolines, amides, amines, succinimides, alkoxylated amines, alkoxylated ether amines, amine oxides, amidoamines, nitriles, betaines, quaternary amines, imines, amine salts, amino guanadine, alkanolamides, and the like.

Such friction modifiers may contain hydrocarbyl groups that may be selected from straight chain branched chain or aromatic hydrocarbyl groups or admixtures thereof, and may be saturated or unsaturated. Hydrocarbyl groups are predominantly composed of carbon and hydrogen but may contain one or more hetero atoms such as sulfur or oxygen. Preferred hydrocarbyl groups range from 12 to 25 carbon atoms and may be saturated or unsaturated. More preferred are those with linear hydrocarbyl groups.

Exemplary friction modifiers include amides of polyamines. Such compounds may have hydrocarbyl groups that are linear, either saturated or unsaturated or a mixture thereof and contain no more than about 12 to about 25 carbon atoms.

Other exemplary friction modifiers include alkoxylated amines and alkoxylated ether amines, with alkoxylated amines containing about two moles of alkylene oxide per mole of nitrogen being the most preferred. Such compounds can have hydrocarbyl groups that are linear, either saturated, unsaturated or a mixture thereof. They contain no more than about 12 to about 25 carbon atoms and may contain one or more hetero atoms in the hydrocarbyl chain. Ethoxylated amines and ethoxylated ether amines are particularly suitable nitrogen-containing friction modifiers. The amines and amides may be used as such or in the form of an adduct or reaction product with a boron compound such as a boric oxide, boron halide, metaborate, boric acid or a mono-, di- or tri-alkyl borate.

The ashless organic polysulfide compounds that may be used as friction modifiers include organic compounds expressed by the following formulae, such as sulfides of oils or fats or polyolefins, in which a sulfur atom group having two or more sulfur atoms adjoining and bonded together is present in a molecular structure.

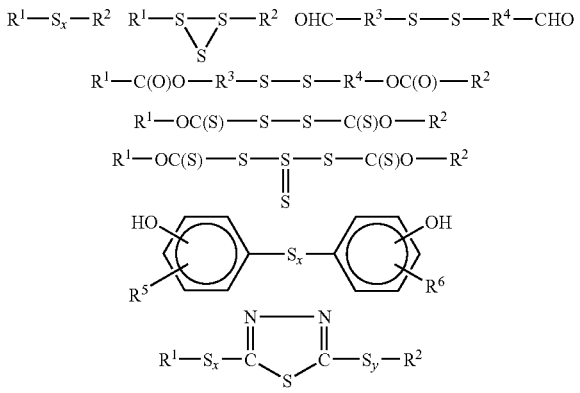

In the above formulae, $R^1$ and $R^2$ independently denote a straight-chain, branched-chain, alicyclic or aromatic hydrocarbon group in which a straight chain, a branched chain, an alicyclic unit and an aromatic unit may be selectively contained in any combined manner. An unsaturated bond may be contained, but a saturated hydrocarbon group is desirable. Among them, alkyl group, aryl group, alkylaryl group, benzyl group, and alkylbenzyl group are particularly desired.

$R^2$ and $R^3$ independently denote a straight-chain, branched-chain alicyclic or aromatic hydrocarbon group which has two bonding sites and in which a straight chain, a branched chain, an alicyclic unit and an aromatic unit may be selectively contained in any combined manner. An unsaturated bond may be contained, but a saturated hydrocarbon group is desirable. Among them, an alkylene group is particularly desirable.

$R^5$ and $R^6$ independently denote a straight-chain or branched-chain hydrocarbon group. The subscripts "x" and "y" denote independently an integer of two or more.

Specifically, for example, mention may be made of sulfurized sperm oil, sulfurized pinene oil, sulfurized soybean oil, sulfurized polyolefin, dialkyl disulfide, dialkyl polysulfide, dibenzyl disulfide, di-tertiary butyl disulfide, polyolefin polysulfide, thiadiazole type compound such as bis-alkyl polysulfanyl thiadiazole, and sulfurized phenol. Among these compounds, dialkyl polysulfide, dibenzyl disulfide, and thiadiazole type compound are desirable. Particularly desirable is bis-alkyl polysulfanyl thiadiazole.

As the lubricant additive, a metal-containing compound such as Ca phenate having a polysulfide bond may be used. However, since this compound has a large coefficient of friction, use of such compound may not always be suitable. To the contrary, the above organic polysulfide compound may be an ashless compound containing no metal, and exhibits excellent performance in maintaining a low coefficient of friction for a long time when used in combination other friction modifiers.

The above ashless organic polysulfide compound (hereinafter referred to briefly as "polysulfide compound") is added in an amount of 0.01 to 0.4 wt %, typically 0.1-0.3 wt %, and desirably 0.2-0.3 wt %, when calculated as sulfur (S), relative to the total amount of the lubricant composition. If the addition amount is less than 0.01 wt %, it is difficult to attain the intended effect, whereas if it is more than 0.4 wt %, there is a danger that corrosive wear increase.

Organic, ashless (metal-free), nitrogen-free friction modifiers which may be used in the lubricating oil compositions disclosed herein are known generally and include esters formed by reacting carboxylic acids and anhydrides with alkanols or glycols, with fatty acids being particularly suitable carboxylic acids. Other useful friction modifiers generally include a polar terminal group (e.g. carboxyl or hydroxyl) covalently bonded to an oleophilic hydrocarbon chain. Esters of carboxylic acids and anhydrides with alkanols are described in U.S. Pat. No. 4,702,850. A particularly desirable friction modifier to use in combination with the titanium compound is an ester such as glycerol monooleate (GMO).

The second friction modifier described above is included in the lubricating oil compositions disclosed herein an amount effective to allow the composition to reliably pass a Sequence VIB fuel economy test in combination with the titanium compound. For example, the second friction modifier may be added to the titanium-containing lubricating oil composition in an amount sufficient to obtain a retained fuel economy improvement of at least 1.7% for an SAE 5W-20 lubricant, 1.1% for a 5W-30 lubricant, and 0.6% for a 10W-30 lubricant as measured at 96 hours (Phase II performance) in the ASTM Sequence VIB Fuel Economy Test. Typically, to provide the desired effect, the second friction modifier may be added in an amount of from about 0.25 wt. % to about 2.0 wt. % (AI), based on the total weight of the lubricating oil composition.

Metal-Containing Detergent

Metal-containing or ash-forming detergents function both as detergents to reduce or remove deposits and as acid neutralizers or rust inhibitors, thereby reducing wear and corrosion and extending engine life. Detergents generally comprise a polar head with a long hydrophobic tail, with the polar head comprising a metal salt of an acid organic compound. The salts may contain a substantially stoichiometric amount of the metal in which they are usually described as normal or neutral salts, and would typically have a total base number (TBN), as may be measured by ASTM D-2896 of from 0 to 80. It is possible to include large amounts of a metal base by reacting an excess of a metal compound such as an oxide or hydroxide with an acid gas such as carbon dioxide. The resulting overbased detergent comprises neutralized detergent as the outer layer of a metal base (e.g., carbonate) micelle. Such overbased detergents may have a TBN of 150 or greater, and typically from 250 to 450 or more.

Known detergents include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., sodium, potassium, lithium, calcium, and magnesium. The most commonly used metals are calcium and magnesium, which may both be present in detergents used in a lubricant, and mixtures of calcium and/or magnesium with sodium. Particularly convenient metal detergents are neutral and overbased calcium sulfonates having TBN of from about 20 to about 450 TBN, and neutral and overbased calcium phenates and sulfurized phenates having TBN of from about 50 to about 450.

In the disclosed embodiments, one or more calcium-based detergents may be used in an amount introducing from about 0.05 to about 0.6 wt. % calcium, sodium, or magnesium into the composition. The amount of calcium, sodium, or magnesium may be determined by Inductively Coupled Plasma (ICP) emission spectroscopy using the method described in ASTM D5185. Typically, the metal-based detergent is overbased and the total base number of the overbased detergent ranges from about 150 to about 450. More desirable, the metal-based detergent is an overbased calcium sulfonate detergent. The compositions of the disclosed embodiments may further include either neutral or overbased magnesium-based detergents, however, typically, the lubricating oil compositions disclosed herein are magnesium free.

Antiwear Agents

Metal dihydrocarbyl dithiophosphate antiwear agents that may be added to the lubricating oil composition of the present invention comprise dihydrocarbyl dithiophosphate metal salts wherein the metal may be an alkali or alkaline earth metal, or aluminum, lead, tin, molybdenum, manganese, nickel, copper, titanium, or zinc. The zinc salts are most commonly used in lubricating oils.

Dihydrocarbyl dithiophosphate metal salts may be prepared in accordance with known techniques by first forming a dihydrocarbyl dithiophosphoric acid (DDPA), usually by reaction of one or more alcohol or a phenol with $P_2S_5$ and then neutralizing the formed DDPA with a metal compound. For example, a dithiophosphoric acid may be made by reacting mixtures of primary and secondary alcohols. Alternatively, multiple dithiophosphoric acids may be prepared where the hydrocarbyl groups on one are entirely secondary in character and the hydrocarbyl groups on the others are entirely primary in character. To make the metal salt, any basic or neutral metal compound may be used but the oxides, hydroxides and carbonates are most generally used. Commercial additives frequently contain an excess of metal due to the use of an excess of the basic metal compound in the neutralization reaction.

The zinc dihydrocarbyl dithiophosphates (ZDDP) that are typically used are oil soluble salts of dihydrocarbyl dithiophosphoric acids and may be represented by the following formula:

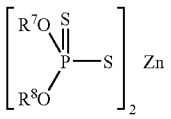

wherein $R^7$ and $R^8$ may be the same or different hydrocarbyl radicals containing from 1 to 18, typically 2 to 12, carbon atoms and including radicals such as alkyl, alkenyl, aryl, arylalkyl, alkaryl and cycloaliphatic radicals. Particularly desired as $R^7$ and $R^8$ groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. $R^7$ and $R^8$) in the dithiophosphoric acid will generally be about 5 or greater. The zinc dihydrocarbyl dithiophosphate can therefore comprise zinc dialkyl dithiophosphates.

In order to limit the amount of phosphorus introduced into the lubricating oil composition by ZDDP to no more than 0.1 wt. % (1000 ppm), the ZDDP should desirably be added to the lubricating oil compositions in amounts no greater than from about 1.1 to 1.3 wt. %, based upon the total weight of the lubricating oil composition.

Other additives, such as the following, may also be present in lubricating oil compositions disclosed herein.

Ashless Dispersants

Ashless dispersants comprise an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. The ashless dispersants may be, for example, selected from oil soluble salts, esters, amino-esters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and a polyalkylene polyamine.

Viscosity Modifiers

Viscosity modifiers (VM) function to impart high and low temperature operability to a lubricating oil. The VM used may have that sole function, or may be multifunctional.

Multifunctional viscosity modifiers that also function as dispersants are also known. Suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

Oxidation Inhibitors

Oxidation inhibitors or antioxidants reduce the tendency of base stocks to deteriorate in service which deterioration can be evidenced by the products of oxidation such as sludge and varnish-like deposits on the metal surfaces and by viscosity growth. Such oxidation inhibitors include hindered phenols, alkaline earth metal salts of alkylphenolthioesters having $C_5$ to $C_{12}$ alkyl side chains, calcium nonylphenol sulfide, ashless oil soluble phenates and sulfurized phenates, phosphosulfurized or sulfurized hydrocarbons, phosphorus esters, metal thiocarbamates and oil soluble copper compounds as described in U.S. Pat. No. 4,867,890.

Rust Inhibitors

Rust inhibitors selected from the group consisting of nonionic polyoxyalkylene polyols and esters thereof, polyoxyalkylene phenols, and anionic alkyl sulfonic acids may be used.

Corrosion Inhibitors

Copper and lead bearing corrosion inhibitors may be used, but are typically not required with the formulation of the present invention. Typically such compounds are the thiadiazole polysulfides containing from 5 to 50 carbon atoms, their derivatives and polymers thereof. Derivatives of 1,3,4 thiadiazoles such as those described in U.S. Pat. Nos. 2,719,125; 2,719,126; and 3,087,932; are typical. Other similar materials are described in U.S. Pat. Nos. 3,821,236; 3,904,537; 4,097,387; 4,107,059; 4,136,043; 4,188,299; and 4,193,882. Other additives are the thio and polythio sulfenamides of thiadiazoles such as those described in UK Patent Specification No. 1,560,830. Benzotriazoles derivatives also fall within this class of additives. When these compounds are included in the lubricating composition, they are typically present in an amount not exceeding 0.2 wt. % active ingredient.

Demulsifying Agent

A small amount of a demulsifying component may be used. A suitable demulsifying component is described in EP 330,522. The demulsifying component may be made by reacting an alkylene oxide with an adduct obtained by reacting a bis-epoxide with a polyhydric alcohol. The demulsifying component may be used at a level not exceeding 0.1 mass % active ingredient. A treat rate of 0.001 to 0.05 mass % active ingredient is convenient.

Pour Point Depressants

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers, polyalkylmethacrylates and the like.

Antifoam Agents

Foam control can be provided by many compounds including an antifoamant of the polysiloxane type, for example, silicone oil or polydimethyl siloxane.

Some of the above-mentioned additives may provide a multiplicity of effects; thus for example, a single additive may act as a dispersant-oxidation inhibitor. This approach is well known and does not require further elaboration.

The individual additives may be incorporated into a base stock in any convenient way. Thus, each of the components can be added directly to the base stock or base oil blend by dispersing or dissolving it in the base stock or base oil blend at the desired level of concentration. Such blending may occur at ambient temperature or at an elevated temperature.

Preferably, all the additives except for the viscosity modifier and the pour point depressant are blended into a concentrate or additive package described herein as an additive package, that is subsequently blended into base stock to make the finished lubricant. The concentrate will typically be formulated to contain the additive(s) in proper amounts to provide the desired concentration in the final formulation when the concentrate is combined with a predetermined amount of a base lubricant.

The concentrate is preferably made in accordance with the method described in U.S. Pat. No. 4,938,880. That patent describes making a pre-mix of ashless dispersant and metal detergents that is pre-blended at a temperature of at least about 100° C. Thereafter, the pre-mix is cooled to at least 85° C. and the additional components are added.

The final lubricating oil formulation may employ from about 2 to about 20 mass %, typically from about 4 to about 18 mass %, and desirably from about 5 to about 17 mass % of the concentrate or additive package with the remainder being base stock.

Example 3

In order to evaluate the wear reducing effect of a lubricant composition made according to the disclosed embodiments, a Sequence IVA Test Method was used. The Sequence IVA test measures a motor oil's ability to inhibit camshaft wear. Using a Nissan 2.3 L, 3 valve per cylinder, 4 cylinder engine, the crankcase oil under consideration was subjected to 100 hours of continuous engine running, cycling from an 800 rpm idle period to a short 1500 rpm stage, and back again, 100 times, under very precise control of operating conditions. At the end of the test, the camshaft was removed and measured for wear. Each of the 12 camshaft lobes was measured in 7 places, and an average lobe wear was computed for the test. Pass limits for the Sequence IVA Test Method include an average cam wear of 120 mm maximum for API SL and ILSAC GF-3 requirements and 90 mm maximum for API SM and ILSAC GF-4 requirements.

The base oil was a mixture of Group I and Group II oils having a viscosity grade of 5W-30. A control run (Run 1) in the Sequence IVA Test was run with a fully formulated lubricant containing glycerol monooleate as the friction modifier. A second run (Run 2) was made with a lubricant composition containing the titanium compound and glycerol monooleate to demonstrate the effectiveness of the combined friction modifier in a fully formulated lubricant.

TABLE 2

Lubricant Composition And Test Results

| | Run 1 | Run 2 |
|---|---|---|
| Component | Amount (wt. %) | Amount (wt. %) |
| 2100 MW polyisobutylene succinimide dispersant | 1.30 | 1.30 |
| 1300 MW polyisobutylene succinimide dispersant | 3.30 | 3.30 |
| 135 Solvent Neutral diluent oil | 0.514 | 0.344 |
| Antifoam agent | 0.006 | 0.006 |
| Aromatic amine antioxidant | 0.74 | 0.74 |
| Sulfurized isobutylene antioxidant | 0.80 | 0.80 |
| 300 TBN Overbased calcium sulfonate detergent | 1.80 | 1.80 |
| Polymethacrylate pour point depressant | 0.40 | 0.40 |
| Mixed primary and secondary Zinc dialkyldithiophosphate | 0.94 | 0.94 |
| Olefin copolymer viscosity index improver | 9.80 | 9.80 |
| Group I, 100 N, Base Oil | 60.60 | 60.60 |
| Group II, Base Oil | 19.50 | 19.50 |
| Glycerol monooleate | 0.30 | 0.30 |
| Titanium neodecanoate | 0.00 | 0.17 |
| Analytical Data | Ppm | ppm |
| Phosphorus | 726 | 754 |
| Calcium | 2072 | 2099 |
| Zinc | 905 | 915 |
| Boron | 240 | 229 |
| Titanium | 0.00 | 109 |
| Sequence IVA Test Results | Microns | Microns |
| Average Cam Lobe Wear (90 microns max.) | 88.18 | 26.56 |

The Sequence IVA test result obtained from Run 2 clearly demonstrated the efficacy of the Ti additive in wear control, as evidenced by comparing that obtained from a non-titanium-containing lubricating oil composition (Run 1). The applicability of the Ti additive as an anti-wear agent is not limited to the composition shown in this example. Accordingly, fully formulated lubricant composition containing the titanium additive in a Group I oil may include Group II, Group II+, Group III, and Group IV, base oils and mixtures thereof.

It is believed that the disclosed embodiments may enable significant improvement in engine wear control without the use of a molybdenum additive. Such molybdenum-free lubricant compositions may provide passenger car motor oils that meet or exceed the ILSAC GF-4 and/or API SM specifications. Also, the compositions described herein may be effective to meet more stringent requirements demanded by some OEM internal specifications for the Sequence IVA or any other wear tests.

At numerous places throughout this specification, reference has been made to a number of U.S. patents and publications. All such cited documents are expressly incorporated in full into this disclosure as if fully set forth herein.

The foregoing embodiments are susceptible to considerable variation in its practice. Accordingly, the embodiments are not intended to be limited to the specific exemplifications set forth hereinabove. Rather, the foregoing embodiments are within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part hereof under the doctrine of equivalents.

What is claimed is:

1. A fully formulated lubricating oil composition comprising:

a) an oil of lubricating viscosity having a viscosity index of at least about 95;

b) at least one calcium detergent;

c) at least one oil soluble titanium compound derived from a titanium alkoxide and a carboxylic acid selected from the group consisting of a non-linear mono-carboxylic acid and a carboxylic acid having more than 22 up to 25 carbon atoms;

d) at least one friction modifier; and e) at least one zinc dihydrocarbyl dithiophosphate compound, wherein said composition is substantially free of molybdenum, has a Noack volatility of about 15 wt. % or less, from about 0.05 to about 0.6 wt. % calcium from the calcium detergent, titanium in an amount of from about 10 ppm to about 1500 ppm from the titanium compound, and phosphorus from the zinc dihydrocarbyl dithiophosphate compound in an amount up to about 0.1 wt. % and wherein lubricating oil composition is substantially devoid of titanium compounds containing phosphorus atoms.

2. The composition according to claim 1, wherein said calcium detergent is selected from the group consisting of calcium phenates, calcium salicylates, calcium sulfonates, and mixtures thereof.

3. The composition according to claim 1, wherein said calcium detergent is an overbased calcium sulfonate.

4. The composition according to claim 3, wherein said overbased calcium sulfonate has a total base number ranging from about 150 to about 450.

5. The composition according to claim 1, wherein said titanium from a titanium compound is present in an amount of about 50 ppm to about 500 ppm.

6. The composition according to claim 1, wherein said titanium compound comprises a reaction product of a titanium alkoxide and an about $C_6$ to about $C_{25}$ non-linear monocarboxylic acid.

7. The composition according to claim 1, wherein said carboxylic acids are selected from the group consisting essentially of cyclohexanecarboxylic acid, phenylacetic acid, benzoic acid, neodecanoic acid, and mixtures thereof.

8. The composition according to claim 7, wherein said carboxylic acid comprises neodecanoic acid.

9. The composition according to claim 1 wherein said titanium compound comprises a compound substantially devoid of sulfur and phosphorus atoms.

10. The composition according to claim 1, wherein said at least one friction modifier is present in an amount ranging from about 0.20 wt. % to about 2.0 wt. %, based on the total weight of the composition.

11. The composition according to claim 1, wherein said at least one friction modifier comprises an ester.

12. The composition according to claim 11, wherein said ester comprises glycerol monooleate.

13. The composition according to claim 1, wherein said at least one friction modifier comprises a compound selected from the group consisting of alkoxylated amines, alkoxylated ether amines, and thiadiazoles.

14. The composition according to claim 1, wherein said composition contains from about 0.025 wt. % to about 0.1 wt. % phosphorus from the zinc dihydrocarbyl dithiophosphate compound.

15. The composition according to claim 14, wherein said composition contains from about 0.025 wt. % to about 0.075 wt. % phosphorus from the zinc dihydrocarbyl dithiophosphate compound.

16. The composition according to claim 15, wherein said composition contains from about 0.025 wt. % to about 0.05 wt. % phosphorus from the zinc dihydrocarbyl dithiophosphate compound.

17. A method for improving the fuel economy and fuel economy retention properties of an internal combustion engine, which comprises: (1) adding to said engine the lubricating oil composition of claim 1; and (2) operating said engine.

18. A method for improving the anti-wear protection of an internal combustion engine comprising the steps of: (1) adding a lubricating oil composition of claims 1; and (2) operating the engine.

19. The composition of claim 1, wherein the titanium compound comprises a reaction product of titanium isopropoxide and neodecanoic acid.

* * * * *